United States Patent [19]

Garnier et al.

[11] 4,082,207

[45] Apr. 4, 1978

[54] ELECTROMAGNETIC APPARATUS FOR CONSTRUCTION OF LIQUID METALS

[75] Inventors: Marcel A. Garnier; René J. Moreau, both of Grenoble, France

[73] Assignee: Agence Nationale de Valorisation de la Recherche (ANVAR), Neuilly sur Seine, France

[21] Appl. No.: 702,399

[22] Filed: Jul. 6, 1976

[30] Foreign Application Priority Data

Jul. 4, 1975 France ..... 75 21075

[51] Int. Cl.[2] ..... B22D 41/08

[52] U.S. Cl. ..... 222/594; 137/827; 164/147

[58] Field of Search ..... 164/49, 147; 137/13, 137/DIG. 10, 827; 417/50; 222/590, 594

[56] References Cited

U.S. PATENT DOCUMENTS 3,177,536 4/1965 Schneider ..... 164/147

3,268,958 8/1966 Sickbert ..... 222/594 UX 3,463,365 8/1969 Dumont-Fillon ..... 222/594 UX

FOREIGN PATENT DOCUMENTS 430,282 11/1974 U.S.S.R.

*Primary Examiner*—Robert B. Reeves

*Assistant Examiner*—David A. Scherbel

*Attorney, Agent, or Firm*—Peter K. Kontler

[57] ABSTRACT

Apparatus for constricting a jet of liquid metal at the outlet of the orifice of a nozzle. The jet is constricted due to the provision of a winding which surrounds the discharge end of the nozzle, and a conductive cylindrical screen which extends into the winding. The apparatus can be used to constrict streams of molten steel, aluminum, copper or copper or aluminum alloys preparatory to flow of molten metal through a joint between two conduits which are not sealingly connected to each other or for the making of wire or small-diameter billets.

11 Claims, 3 Drawing Figures

Fig. 1.
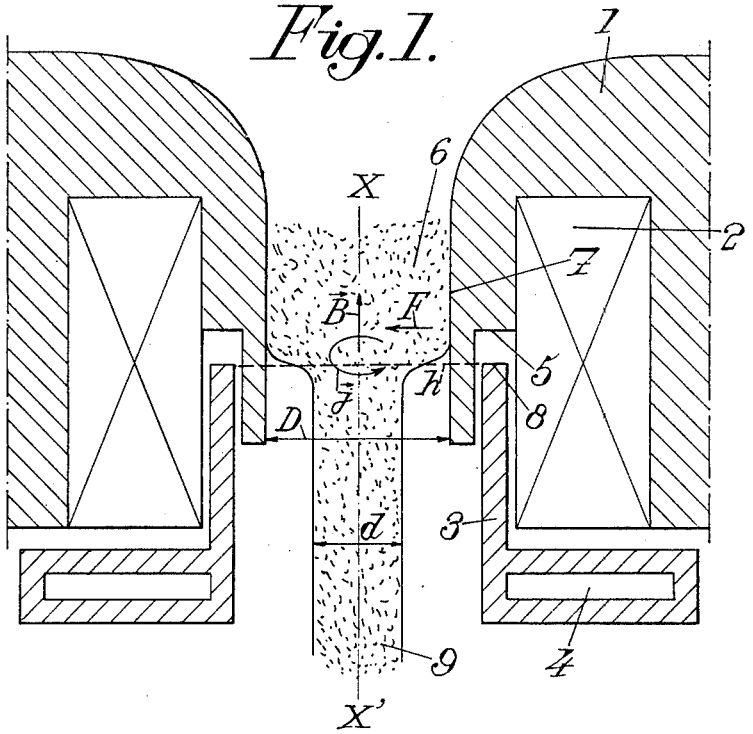
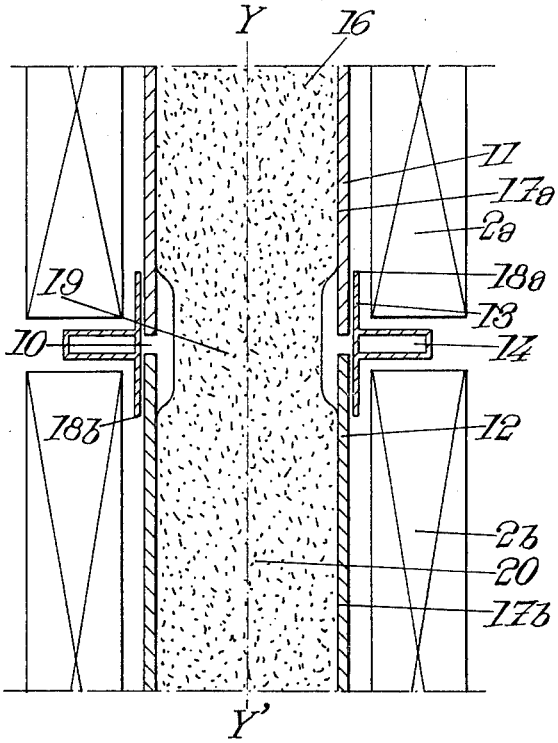
Fig. 2.

ELECTROMAGNETIC APPARATUS FOR CONSTRUCTION OF LIQUID METALS

BACKGROUND OF THE INVENTION

The present invention relates to the constriction of liquid metals, especially liquid steel, liquid aluminum, liquid copper or liquid uranium, and their alloys; more particularly it concerns the constriction of these metals with the aid of electromagnetic forces.

It has already been proposed to constrict liquid metals, especially liquid aluminum and its alloys, by means of electromagnetic forces (French Pat. Nos. 1,509,962 filed Oct. 4, 1966 and 2,160,281 filed Nov. 17, 1971). Such known apparatus permit only the fabrication of large ingots having a diameter above 30 mm, the lines of force of the magnetic field replacing the conventional ingot mould in the formation of the ingots.

SUMMARY OF THE INVENTION

The apparatus according to the invention is much more versatile because it permits the constriction or compression of a jet of molten metal, especially molten steel, aluminum or copper, leaving an orifice, producing a jet of small diameter (a few mm).

The invention allows especially:

the use of an orifice of relatively large diameter, that is to say without risk of blocking, for forming a jet or casting of relatively small diameter;

the formation of billets of small diameter (a few mm in diameter) or even of wires, by forming a jet of reduced diameter at the orifice exit, e.g. from a pouring or casting ladle, producing the restriction of a jet at a joint between two elements, whence the possibility of passing a liquid metal from a first element to a second element, without interruption at the surfaces of the joint;

the regulation of the throughput of the stream of liquid metal, its speed or its pressure by reduction of its section by means of apparatus according to the invention;

the continuous flow of metals, especially of steel, aluminum, copper and uranium, whether by using the apparatus according to the invention to control the throughput or any other flow parameter, whether by its use to solve a junction problem, or further whether by its use to suppress, replace or improve any stage of the conventional operation of continuous flow;

the solution of numerous problems of protection of materials surrounding a stream of liquid metal by using the apparatus according to the invention to avoid contact between these materials and the liquid metal;

the solution of numerous problems of pollution or contamination of a liquid metal by the surfaces which contain it by reducing or avoiding contact between the metal and the surfaces.

The invention consists in the provision of an apparatus for restricting a jet of liquid metal. The apparatus comprises, at the level of the outlet orifice of a nozzle or conduit forming the said jet, on the one hand, means for creating an overpressure in the jet constituted by a winding surrounding the nozzle and disposed at its exit in combination with means for passing a high frequency alternating current through the winding and, on the other hand, means for removing this overpressure.

In the preferred embodiment the means for removing the overpressure in the jet are constituted by a screen of electrically conductive material, especially of copper, concentric with the winding and extending into the interior thereof, means being provided for cooling both the winding and the screen to remove the heat which is produced by the alternating current flowing in the winding.

One can then effect, in particular, separation of more or less conductive inclusions from the liquid metal by using the fact that these inclusions and the liquid metal experience differently the transition between the region where the magnetic induction is present (within the winding) and the region where it is absent (within the screen).

In the case of the joint, there is provided in addition a second winding disposed at the entrance of the second or downstream conduit of the joint the first winding being disposed at the outlet of the first or upstream conduit and equally traversed by the said alternating high frequency current, the said screen penetrating equally the interior of the second winding.

In the second embodiment, the means for removing the overpressure in the jet are constituted by another winding disposed downstream of the winding creating the overpressure, in combination with means for passing through the other winding a high frequency alternating current of opposite phase to that traversing the winding creating the overpressure, means being provided for cooling the two windings to remove the heat produced by the passage of the alternating currents.

The invention will be explained in detail in the following description with reference to the appended drawings.

BRIEF DESCRIPTION OF THE DRAWINGS

FIG. 1 is an axial sectional view of a nozzle provided with improvements (winding and screen) according to the invention.

FIG. 2 is an axial section showing the application of the invention to obtaining a joint without interruption of the stream at the level of the joint.

DESCRIPTION OF THE PREFERRED EMBODIMENTS

Figure 3:
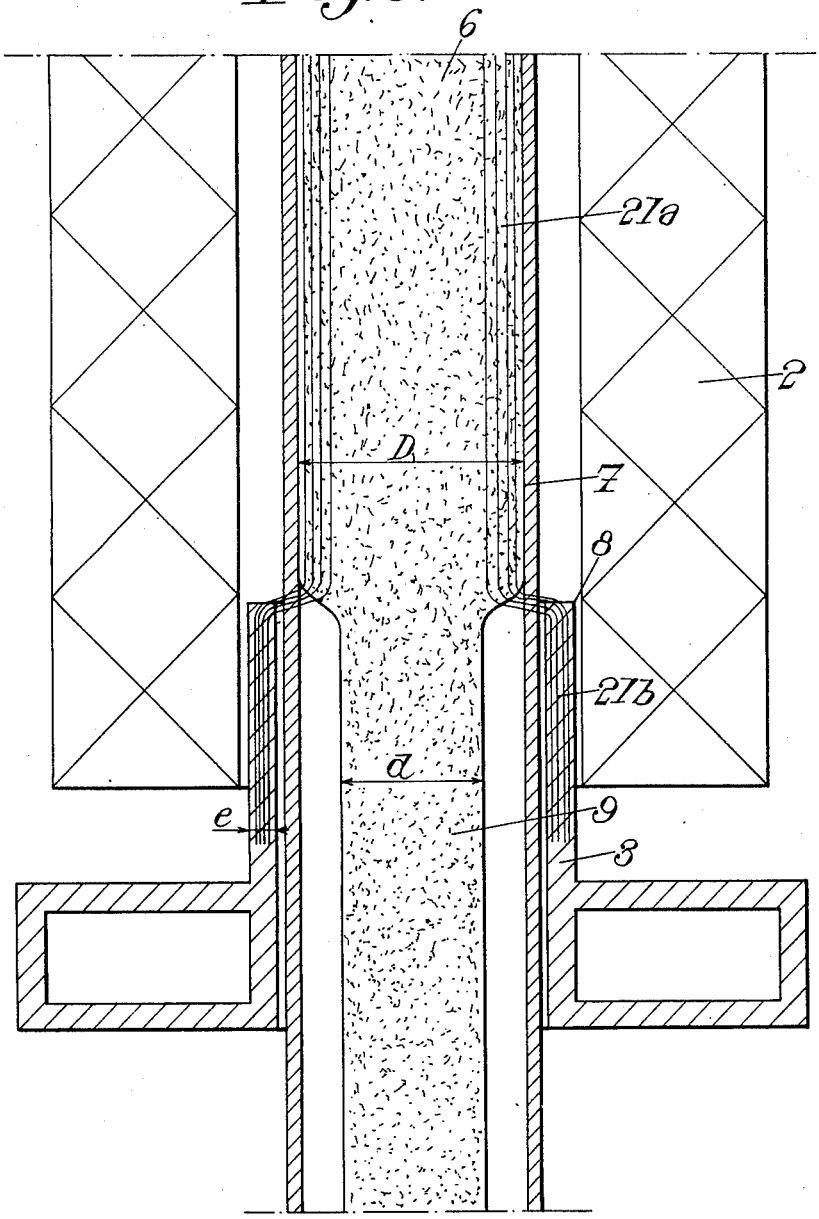
FIG. 3 is an axial section, on a larger scale, showing the disposition of the lines of force in the nozzle of FIG. 1.

According to the invention for producing the constriction by means of electromagnetic forces, of a jet of liquid metal, especially of a jet of liquid steel, aluminum, or copper, one proceeds as follows or in an analogous manner.

Reference being had to FIG. 1, one sees that an apparatus according to the invention has around a conduit or nozzle 1 of exit diameter D:

on the one hand, a winding 2 having a common axis X—X' with the nozzle 1, with means (not shown) for supplying to this winding a high frequency alternating current, and on the other hand, a screen 3 coaxial with the nozzle 1 and extending partially into the interior of the winding 2, this screen being formed of an electrically conductive metal, especially copper, means being provided for cooling together the winding 2 (for example a current of air traverses the turns of this winding) and the screen 3 (for example a fluid circulates through the passage 4 in the screen 3).

As seen in FIG. 1, the nozzle 1 may have a recess 5 protecting the screen 3 which extends into the interior of the winding 2.

The inventors have ascertained that with this structure the jet of liquid metal 6 in the nozzle 1 loses contact with the surface 7 of this nozzle at the level *h* of the upper end face 8 of the screen 3 by being confined by the electromagnetic forces engendered by the winding 2, for reasons set out in detail below. The thus constricted jet presents a diameter *d* less than the diameter D after the level *h* whereafter the constricted jet 9 is no longer in contact with the surface 7 of the nozzle 1.

It will be seen that one can thus determine with precision the position of separation of the jet by fixing the position of the end face 8 of the screen 3 which penetrates into the winding 2, means being providable for displacing the screen 3 relative to the recess 5 of the nozzle, in a manner enabling variation of the position where the jet 8 becoms separated from the surface 7 of the nozzle. On the other hand, one can regulate the diameter *d* of the jet by modifying the intensity of the electric current traversing the winding 2; one may similrly obtain control of the diameter *d* to a given value.

The phenomenon is reversible as can be seen from FIG. 2 in which is illustrated a joint 10 between two tubular elements or conduits 11 (first or upstream element and 12 (second or downstream element). In this case two windings 2*a* and 2*b* are provided having the same axis Y—Y' as the assembly of the two tubular aligned elements 11 and 12, these windings being traversed by an alternating high frequency current, and a screen 13 consisting of electrically conductive material, especially copper, and having a cooling channel 14.

At the level of the upstream limit of the screen 13, the jet of liquid metal 16 becomes separated from the surface 17*a* of the upstream element 11 due to electromagnetic constriction produced by the winding 2*a*. At the level of the downstream level 18*b* of the screen 13, the constricted jet moves back to the surface 17*b* of the downstream element 12 forming a jet 20 which comes into contact with this surface 17*b*.

Due to the separation at the level of the joint 10, movement past this joint is made without catching on the surface at this level, which is very advantageous, in avoiding in particular all leakage and all wear at the level of the joint, or moreover in allowing the addition of various substances to the liquid metal via the inlet orifice thus provided at the level of the joint.

There will now be explained the reasons for which, according to the inventors, the apparatus illustrated in FIG. 1 permits obtaining restriction of the jet.

To obtain restriction of a cylindrical jet of an electrically conductive fluid at rest, it is sufficient to subject it to the action of electromagnetic centripetal forces obtained by the interaction of a magnetic field and appropriate electric currents. This is easily effected. On the contrary such a system of a magnetic field and electric currents does not have the same effect on a cylinder of electrically conductive fluid in motion. In effect, in a flow of such a fluid, two quantities are invariables, these being:

the throughput $Q = SV$, the dynamic prssure head $H = P/\rho g + V^2/2g$ in which S is the cross section, V the velocity, P the pressure, $\rho$ the density of the liquid metal, and $g$ the acceleration by gravity.

To obtain constriction or contraction of a stream of liquid metal in motion to separate it from the surface, it is necessary to reduce the section S thus increasing the velocity V (because Q is constant) and in consequence reducing the pressure which obtains at the centre of the flow (because H is constant and V has been increased).

It is thus seen that if a system of centripetal forces engendering an internal overpressure allows constriction of a cylinder of electroconductive fluid at rest, the same system of centripetal forces causes the expansion of a stream of electroconductive fluid in motion. This phenomenon has heretofore prevented, for the most part, attempts to constrict liquid metals in motion.

In the system of FIG. 1, the jet of liquid metal 6 is caused to enter into an alternating magnetic field of axis $\vec{B}$ and it carries an induced circular current $\vec{j}$ in phase with the magnetic field $\vec{B}$. Each unit volume of metal of the jet 6 is thus subjected to a force $\vec{F}$ equal to the vectorial product of $\vec{j}$ and of $\vec{B}$, this force $\vec{F}$ being radial and centripetal.

There is thus produced within the liquid metal traversing the winding 2 an overpressure such that the Lorentzian force created by this winding is exactly balanced by a centrifugal pressure gradient. The fact of having established this overpressure and of being able to suppress it rapidly readily allows reduction of the pressure and in consequence increase in velocity and decrease in cross section, this being precisely the object sought.

The contraction occurs very rapidly if the removal of the overpressure, hence of the magnetic induction B, is itself very rapid. The purpose of the conductive screen 3 which extends into the interior of the winding 2 is precisely to suppress abruptly the magnetic induction.

Because of the relatively high frequency of the alternating current applied to the winding 2, the field penetrates only a small distance into the liquid metal constituting the column 6, as can be seen from FIG. 3 where the lines of force of the magnetic field are represented by 21*a* at the interior of the column 6. The field lines 21*a* localised in the "skin" at the surface of the liquid column 6 abruptly leave this column at the level of the upper end face 8 of the screen 3 to penetrate the said screen (field lines 21*b*). If the screen 3 is of sufficient thickness, the magnetic field disappears abruptly and totally from the liquid jet as soon as it enters the zone protected by the screen 3. There is thus produced a very abrupt decrease in the pressure in the jet in the axial direction and in consequence a contraction of the stream of liquid metal (constricted stream 9) which shows itself by a separation of the jet relative to the surface 7 at the level of the upper limit 8 of the screen 3.

Thus the constriction of the jet of liquid metal, which cannot be obtained with a winding alone, is obtained due to the combination of the winding 2 and the screen 3.

There will now be examined how to obtain the desired characteristics by choosing the different parameters of the apparatus whose influence will be studied successively, these parameters being the frequency of the current applied to the winding 2, the intensity of this current and finally the electrical power expended.

1. Frequency of the current

The frequency *f* of the current applied to the winding 2 should be adjusted so that the depth of penetration $\delta$ of the magnetic induction corresponds to the two following conditions:

$\delta < R$ and $\delta < e,$

R being the radius of the jet of metal before contraction ($R = D/2$) and $e$ the thickness of the metal screen 3.

One has:

$$f > -1/_{\pi}\mu\sigma m R^2 \quad f > 1/_{\pi}\mu\sigma c e^2$$

with $\sigma m$ and $\sigma c$ representing the electrical conductivity respectively of the metal constituting the jet 6 (for example steel or aluminum) and of the metal constituting the screen 3 (for example copper).

As an example, for liquid steels of conductivity $\sigma m$ of approximately $10^6\Omega^{-1}m^{-1}$ and for a jet of radius equal to 1 cm, the frequency to observe is about 2500 Hz. The minimum thickness of the screen, if it is of copper ($\sigma c = 10^8/2\Omega\Omega^{-1}m^{-1}$), is then 1.5 mm. With a jet of metal of higher conductivity such as liquid aluminum or copper ($\sigma m = 5 \times 10^6\Omega^{-1} m^{-1}$), the optimum frequency would be lower ($f \sim 500$ Hz for aluminum or its alloys and between about 500 and about 1000 Hz for copper or its alloys).

2. Intensity of the current

The intensity of the current applied to the induction winding 2 creating the magnetic field determines the value of the magnetic induction B and likewise that of the contraction $\alpha$ of the jet ($\alpha$ is equal to the ratio between the diameters of the jet after and before contraction: $\alpha = d/D$).

For a jet of metal having an initial velocity $V_o$, one has:

$$\alpha = (1 + B_o^2/\rho\mu V_o^2)^{-\frac{1}{2}}$$

with $B_o = \mu nI/l$ $l$ being the length of the winding, nI the number of inductance ampere turns and $\rho$ and $\mu$ respectively the density and magnetic permeability of the liquid metal, as above.

The Table below indicates the values of the contraction $\alpha$ obtained with a jet 6 of liquid steel, for various values of the initial velocity $V_o$ of the metal (in cm/sec) and different numbers of ampere turns to which correspond the values of the magnetic induction $B_o$ in gauss (the length of the winding is assumed to be cm).

| mI (ampere turns) | $B_o$ (gauss) | $V_o$ (cm/sec) 12.5 | 25 | 50 | 100 |
|---|---|---|---|---|---|
| 10,000 | 1,000 | 0.34 | 0.48 | 0.65 | 0.82 |
| 20,000 | 2,000 | 0.24 | 0.34 | 0.48 | 0.65 |
| 30,000 | 3,000 | 0.20 | 0.28 | 0.40 | 0.55 |
| 40,000 | 4,000 | 0.17 | 0.24 | 0.34 | 0.48 |

3. Power of current expended

The winding 2 possesses an essentially inductive impedance; it is therefore associated with an assembly of condensers (not shown) to obtain a circuit suited to the frequency $f$. Under these circumstances the power expended in the assembly constituted by the winding 2 and the assembly of condensers, which should be furnished by the external network (not shown), is a purely active power which, for the example given in the Table above, never exceeds a few kilowatts.

The apparatus according to the invention can be applied advantageously for the following purposes:

use of an orifice of relatively large diameter to obtain nevertheless a jet of relatively small diameter, without risk of blockage of the orifice;

obtaining billets of small diameter (diameter of the order of a few millimeters) or occasionally small ingots without contact with the sides of the ingot mould, the sudden suppression of the magnetic induction effecting constriction of the billet or ingot, means being provided for assuring cooling of the billet or ingot during its constriction;

avoidance of one of the conventional stages of operation of wire-forming, due to the formation, by the apparatus according to the invention, of a jet of reduced diameter relative to the diameter of the orifice, which permits reduction of the investment and operational expense of a wire-forming installation; one can thus produce the rough forms of metal wires (wires of steel and aluminum for example), cooling means being provided to solidify the constricted jet;

solution of numerous problems at joints or of watertightness at joints, by controlling the free surface of the liquid metal in the region where that surface is separated from the walls, with particular application to joining problems posed by the supply of ingot moulds with continuous horizontal flow of steels.

The apparatus according to the invention possesses in addition the precise advantage of allowing reheating of the liquid metal by means of Foucault currents induced in the metal downstream of the contraction, and of thus reducing the risks of blockage or of other problems due to premature cooling.

A feature to be noted is the great flexibility of adaptation of the apparatus according to the invention to existing installations due to the fact that this apparatus demands no particular geometry, nor any precise dimension of the winding or of the screen.

Finally there are given two numerical examples of possible applications of the invention.

(a) Arrangement of FIG. 1 for controlling the quality of a jet of liquid steel:

hot resistivity $= 160.10^{-8}\Omega/m$
density of liquid steel $= 7.10^3 kg/m^3$
dynamic viscosity $= 4.10^{-2}$ poises
temperature $T = 1580°$ C
upstream pressure $P_o = 1 \ 2.10^{-5} P_a$
$D = 40$ to 50 mm
$d = 30$ to 40 mm Breaking up of the jet is thus prevented, and its quality improved.

(b) Arrangement of FIG. 2 for obtaining watertightness between two non-joined tubes, 11 and 12, through which a liquid metal runs:

$D = 50$ to 100 mm
$d = 40$ to 90 mm
$P_o = 1$ to $2.10^5 P_a$
$P_s = 1$ to $1.5.10^5 P_a$
system vertical or horizontal.

As will be apparent, the invention is not limited only to those modes of application and operation which have been more specifically considered, it embraces, on the contrary, all variations.

In particular in place of obtaining the suppression of the magnetic induction, and hence the overpressure in the jet, by means of a screen, one can provide another winding connected to a second source of alternating current, in which the electric current is forced in opposite phase to the current passing in the first winding; the result will be the same: to cancel exactly the ampere turns exterior to the stream of liquid metal. This variation permits adaptation of the apparatus to low frequencies for which a screen, provided for the higher frequencies, is no longer adequate to overcome the magnetic induction. In effect, if the frequency is changed, the thickness of the skin changes also, whereas the thickness of the screen remains fixed. The said other winding, of opposite phase to the winding 2, will be wholly equivalent to a screen whose variable thickness adapts itself always to the frequency used.

We claim:

1. Apparatus for constricting a stream of liquid metal, comprising a conduit having an open dicharge end through which the stream of liquid metal issues; an electrical winding disposed around and having a portion extending beyond the discharge end of said conduit, as considered in the direction of flow of liquid metal, means for passing through said winding a high-frequency alternating current thereby generating an overpressure in the stream of liquid metal passing through said discharge end; and an electrical screen including a hollow cylinder consisting of electrically conductive material, said screen being coaxial with and extending into said portion of said winding.

2. Apparatus according to claim 1, further comprising means for cooling said window and said screen to withdraw the heat produced by the alternating current passing through said winding.

3. Apparatus according to claim 1, wherein said conductive material is copper and the thickness of said hollow cylinder exceeds the depth of penetration, by skin effect, of field lines in said stream due to said alternating current of high frequency passing through said winding.

4. Apparatus according to claim 1, wherein said liquid metal is steel and the frequency of the alternating current is approximately 2,500 Hz.

5. Apparatus according to claim 1, wherein said liquid metal is pure or alloyed aluminum and the frequency of the alternating current is approximately 500 Hz.

6. Apparatus according to claim 1, wherein said liquid metal is pure or alloyed copper and the frequency of the alternating current is between 500 and 1,000 Hz.

7. Apparatus for constricting a stream of liquid metal, comprising a first conduit having a discharge end from which the stream of liquid metal issues; a second conduit aligned with said first conduit and having an intake end for entry of the stream of liquid metal which issues from said discharge end; a first electrical winding surrounding said first conduit and terminating short of said discharge end, as considered in the direction of flow of liquid metal in said first conduit; a second electrical winding surrounding said second conduit downstream of said intake end, as considered in said direction; means for passing through said windings a high-frequency alternating current thereby generating an overpressure within said stream of liquid metal passing through said discharge end and into said intake end; and an electrical screen including a hollow cylinder consisting of electrically conductive material and surrounding said discharge and intake ends, said cylinder being coaxial with said windings and extending into said first winding upstream of said discharge end and into said second winding downstream of said intake end.

8. Apparatus according to claim 7, further comprising means for cooling said windings to withdraw heat produced by the passage of alternating current, the phase of current passing through one of said windings being opposite the phase of current passing through the other of said windings.

9. Apparatus according to claim 7, wherein said liquid metal is steel and the frequency of the alternating current is approximately 2,500 Hz.

10. Apparatus according to claim 7, wherein said liquid metal is pure or alloyed aluminum and the frequency of alternating current is approximately 500 Hz.

11. Apparatus according to claim 7, wherein said liquid metal is pure or alloyed copper and the frequency of alternating current is between 500 and 1,000 Hz.

* * * * *

UNITED STATES PATENT AND TRADEMARK OFFICE

CERTIFICATE OF CORRECTION

PATENT NO. : 4,082,207

DATED : April 4, 1978

INVENTOR(S) : Marcel A. Garnier, Rene J. Moreau

It is certified that error appears in the above-identified patent and that said Letters Patent are hereby corrected as shown below:

Col. 3, line 19, "8" should read --9--;
line 22, "si-" should be deleted;
line 23, "milrly" should be deleted, "similrly" should be changed to --similarly--;
line 63, "prssure" should read --pressure--.
Col. 5, line 47, --13-- should be inserted before "cm).";
line 51, (Table) "mI" should read --nI--.

Col. 6, line 46, --to-- should be inserted before "$2.10^{-5}P_a$".
Col. 7, line 28, "window" should read --winding--.

Signed and Sealed this

Fifth Day of June 1979

[SEAL]

*Attest:*

RUTH C. MASON
*Attesting Officer*

DONALD W. BANNER
*Commissioner of Patents and Trademarks*